US008696013B2

(12) United States Patent
Saunders

(10) Patent No.: US 8,696,013 B2
(45) Date of Patent: Apr. 15, 2014

(54) SNOWBOARD BINDING

(76) Inventor: Bart Saunders, Sunnyvale, CA (US)

( * ) Notice: Subject to any disclaimer, the term of this patent is extended or adjusted under 35 U.S.C. 154(b) by 212 days.

(21) Appl. No.: 13/032,632

(22) Filed: Feb. 22, 2011

(65) Prior Publication Data

US 2012/0211968 A1 Aug. 23, 2012

(51) Int. Cl.

| | |
|---|---|
| ***A63C 9/00*** | (2012.01) |
| ***A63C 10/18*** | (2012.01) |
| *A63C 10/24* | (2012.01) |
| *A63C 10/04* | (2012.01) |

(52) U.S. Cl.

CPC ..... *A63C 10/18* (2013.01); *A63C 10/24* (2013.01); *A63C 10/045* (2013.01)

USPC ..... 280/623

(58) Field of Classification Search

CPC ..... A63C 10/045; A63C 10/24; A63C 10/18

USPC ..... 280/623, 613, 14.21, 14.22, 617, 618

See application file for complete search history.

(56) References Cited

U.S. PATENT DOCUMENTS

| | | | | | |
|---|---|---|---|---|---|
| 5,172,924 | A * | 12/1992 | Barci | ..... | 280/14.22 |
| 5,544,909 | A * | 8/1996 | Laughlin et al. | ..... | 280/617 |
| 5,577,756 | A * | 11/1996 | Caron | ..... | 280/617 |
| 5,649,722 | A * | 7/1997 | Champlin | ..... | 280/818 |
| 5,667,237 | A * | 9/1997 | Lauer | ..... | 280/607 |
| 5,857,700 | A * | 1/1999 | Ross | ..... | 280/623 |
| 5,947,488 | A * | 9/1999 | Gorza et al. | ..... | 280/14.21 |
| 6,290,243 | B1 * | 9/2001 | Beran | ..... | 280/14.24 |
| 6,293,566 | B1 * | 9/2001 | Carpenter et al. | ..... | 280/14.21 |
| 6,364,323 | B1 * | 4/2002 | Coulter | ..... | 280/14.22 |
| 6,945,543 | B2 * | 9/2005 | De Bortoli et al. | ..... | 280/14.21 |
| 7,837,219 | B1 * | 11/2010 | Cordes | ..... | 280/618 |

* cited by examiner

*Primary Examiner* — J. Allen Shriver, II

*Assistant Examiner* — Brian Cassidy

(74) *Attorney, Agent, or Firm* — Invent Capture, LLC.; Samuel S. Cho

(57) ABSTRACT

A novel snowboard binding provides a high level of adjustability, convenience, and usability for snowboarders. One aspect of the invention discloses a hook-and-go strapping system which reduces or eliminates cumbersome effort to strap or release snowboard boots to a conventional snowboard binding. Another aspect of the invention discloses a locking lever and a spring-loaded locking plate, which uniquely enable an "on-the-fly" stance positioning of a snowboard binding. The on-the-fly stance positioning as disclosed in some embodiments of the invention involves an easy rotational or angular adjustment of a snowboard binding from a snowboard even after a snowboard boot is strapped into the snowboard binding. Yet another aspect of the invention discloses a unique leg support apparatus comprising a forward lean bar, a tool-free forward lean adjuster with one or more fitting grooves, and a tilt-adjustable articulating high back for fine adjustability and comfort.

20 Claims, 7 Drawing Sheets

700

200

300

400

500

600

700

SNOWBOARD BINDING

BACKGROUND OF THE INVENTION

The present invention generally relates to sports equipment. More specifically, the invention relates to a novel snowboard binding design.

Snowboarding has gained popularity as a winter sport in the last several decades. A typical snowboard requires a binding structure attached to a surface of a snowboard. This binding structure, commonly called a "snowboard binding," enables a snowboarder's foot to be firmly attached to the snowboard. Snowboarders typically wear specialized snowboard boots on both feet and place each snowboard boot inside a snowboard binding per foot (i.e. a left-foot snowboard binding and a right-foot snowboard binding) when the snowboard binding is already attached to the snowboard.

Conventional snowboard bindings are difficult to adjust once they are configured to a particular position or an angle with an attached snowboard boot and a snowboard. For example, the rotational angle of a snowboarder's foot cannot be adjusted easily once the snowboard boot is bound in a conventional snowboard binding. It is also difficult to adjust an angle of a snowboarder's calf once the snowboard boot is bound in a conventional snowboard binding. Moreover, the snowboarder cannot quickly slide in and out of the conventional snowboard binding using conventional strap designs. Therefore, the physically-restrictive nature of conventional snowboard binding designs causes discomfort and inconvenience to snowboarders.

Accordingly, a novel snowboard binding which provides more flexible adjustments and easier foot entry and exit from a snowboard binding may provide significant benefits to snowboarders. Furthermore, a novel snowboard binding which provides adjustment flexibilities to snowboarders while retaining a level of safety and reliability comparable or superior to conventional snowboard designs may be highly beneficial.

SUMMARY

Summary and Abstract summarize some aspects of the present invention. Simplifications or omissions may have been made to avoid obscuring the purpose of the Summary or the Abstract. These simplifications or omissions are not intended to limit the scope of the present invention.

In one embodiment of the invention, a snowboard binding for securely placing a snowboard boot is disclosed. This snowboard binding comprises a snowboard binding base; a strap with a strap surface, a strap adjuster, and a hook, wherein the strap has a fixed hinge on a first side of the strap and a hook on a second side of the strap; a latch which can receive the hook for forming a closed position for the strap, wherein the strap can be tightened with the strap adjuster to hold the snowboard boot securely in the closed position; and a spring-loaded locking plate protruding into or retracting from a snowboard binding disc to lock or release a rotational position of the snowboard binding, wherein the spring-loaded locking plate is controlled by a locking lever.

In another embodiment of the invention, a hook-and-go hinged strapping system for a snowboard binding is also disclosed. This hook-and-go hinged strapping system comprises a snowboard binding base; a strap with a strap surface, a strap adjuster, and a hook, wherein the strap has a fixed hinge on a first side of the strap and a hook on a second side of the strap and wherein the strap provides an open position for an easy entry or exit for a snowboard boot; and a latch which can receive the hook for form a closed position for the strap, wherein the strap can be tightened with the strap adjuster to hold the snowboard boot securely in the closed position.

In another embodiment of the invention, an on-the-fly stance positioning apparatus for a snowboard binding is disclosed. This on-the-fly stance positioning apparatus comprises a snowboard binding base; a spring-loaded locking plate protruding into or retracting from a snowboard binding disc to lock or release a rotational position of the snowboard binding; and a locking lever controlling the spring-loaded locking plate to be placed in a locked position or a released position.

DETAILED DESCRIPTION

Figure 1:
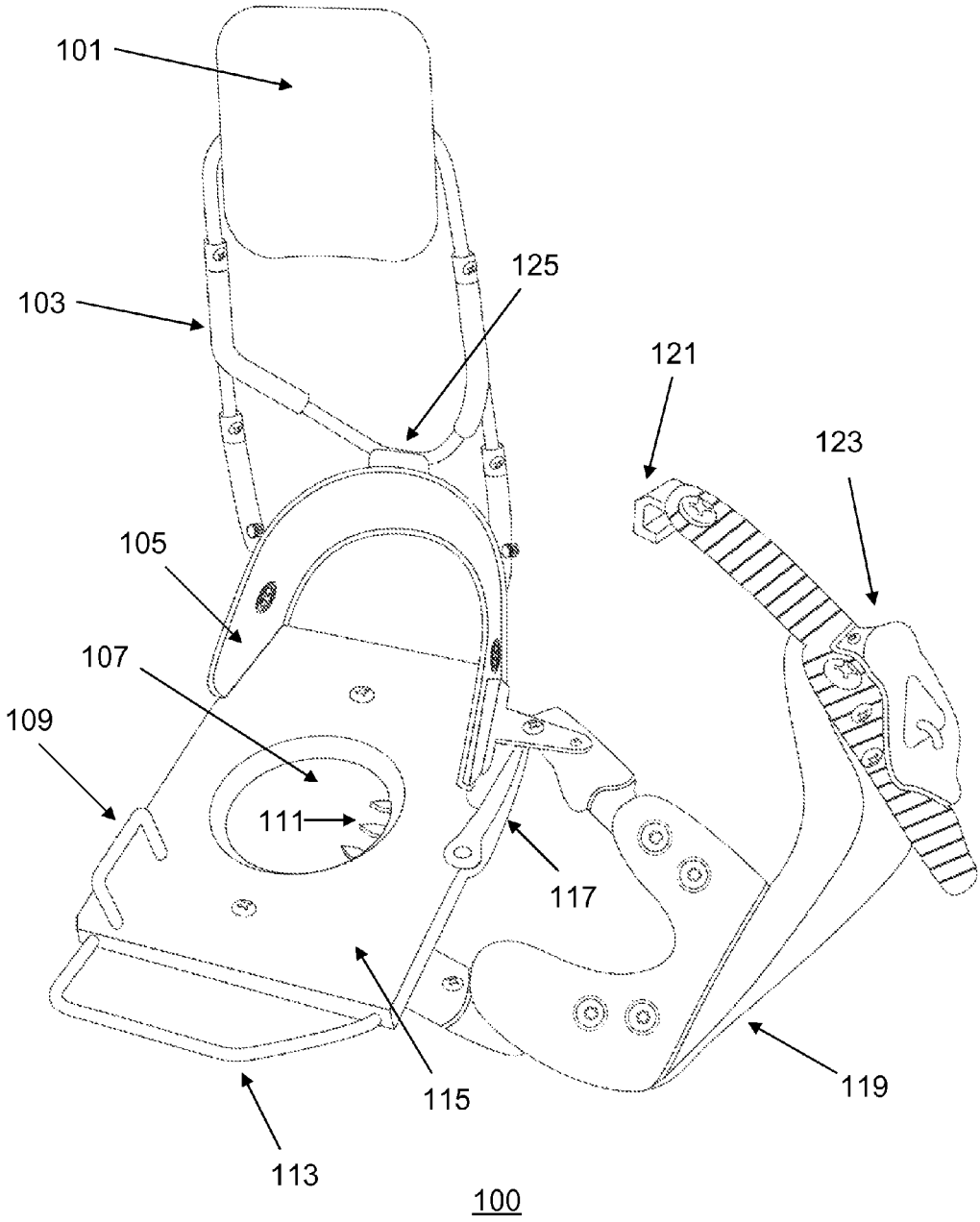
FIG. 1 shows a frontal perspective view of a snowboard binding with a hinged strap in an open position in accordance with an embodiment of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

The detailed description is presented largely in terms of description of shapes, configurations, and/or other symbolic representations that directly or indirectly resemble a novel snowboard binding. These descriptions and representations are the means used by those experienced or skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment. Furthermore, separate or alternative embodiments are not necessarily mutually exclusive of other embodiments. Moreover, the order of blocks in process flowcharts or diagrams representing one or more embodiments of the invention do not inherently indicate any particular order nor imply any limitations in the invention.

For the purpose of describing the invention, a term "on-the-fly stance positioning" is defined as an ability to rotate a snowboard binding around a snowboard binding disc placed on top of the snowboard binding. Typically, the snowboard binding disc securely holds a snowboard binding and a snowboard together with one or more screws or other attaching securing means connecting the snowboard binding disc, the snowboard binding, and the snowboard. In a preferred embodiment of the invention, a snowboard binding, which is held at a secure position with a snowboard binding disc screwed on top of the snowboard binding and a snowboard below, has a releasable locking lever and a locking plate, wherein the locking plate can be engaged into the snowboard binding disc for a fixed position of the snowboard binding, or disengaged from the snowboard binding disc for a rotational adjustment (i.e. on-the-fly stance positioning) of the snowboard binding. In the preferred embodiment of the invention, the locking plate has multiple points of contact to the snowboard binding disc. For example, the multiple points of contact can be established using a locking plate with a multiple number of prongs.

Furthermore, for the purpose of describing the invention, a term "hook-and-go hinged strapping system" is defined as a device capable of opening or closing a strap conveniently with a hook attached at one end of the strap and a latch allowing the hook to form a closed position for the strap, wherein the strap is length-adjustable and binds a snowboard boot encapsulating a snowboarder's foot securely. In a preferred embodiment of the invention, one or more hinges provide an attachment of a first side of the strap to a snowboard binding, and a hook attached to the strap and a latch located near a heel cup of the snowboard binding provides a lockable/releasable attachment of a second side of the strap to the snowboard binding.

In addition, for the purpose of describing the invention, a term "tool-free forward lean adjustment" is defined as an ability to change an angle or a position of a leg support apparatus without using a tool such as a screw driver for easy ergonomic adjustment of a snowboarder's lower leg angle or position, wherein the leg support apparatus forms part of a snowboard binding. In a preferred embodiment of the invention, a leg support apparatus is an articulating high back with a forward lean bar.

Moreover, for the purpose of describing the invention, a term "articulating high back" is defined as a padded portion of a leg support apparatus, which flexibly supports a snowboarder's lower leg. In a preferred embodiment of the invention, the articulating high back can be flexibly tilted forward or backward up to an allowed range of tilt. The flexible tilt feature of the articulating high back, when combined with a tool-free forward lean adjustment, provides a high level of leg position and angle (i.e. forward lean) adjustability and comfort.

One aspect of the present invention is providing an easily-adjustable foot position or stance even after a snowboard boot is strapped into a snowboard binding attached to a snowboard using a unique locking plate and locking lever apparatus. This novel concept is presented herein as an "on-the-fly stance positioning". Another aspect of the present invention is providing an easy entry into and easy exit from a snowboard binding for a snowboarder's foot (i.e. typically encapsulated in a snowboard boot) using a novel apparatus called "hook-and-go" hinged strapping system. Yet another aspect of the present invention is providing a tool-free forward lean adjustment using a tool-free forward lean adjuster locked into a particular groove and/or an articulating high back for a flexible adjustment of a snowboarder's lower leg.

FIG. 1 shows a frontal perspective view of a snowboard binding (100) with a hinged strap (119, 121, 123) in an open position in accordance with an embodiment of the invention. In a preferred embodiment of the invention, the snowboard binding (100) comprises a snowboard binding base (115), a strap surface (119) with a fixed hinged attachment on one side of the snowboard binding base (115), a strap adjuster (123) capable of lengthening or shortening the length of a strap, and a hook (121) on one end of the strap. In the preferred embodiment of the invention, the strap surface (119) with the fixed hinged attachment on one side of the snowboard binding base (115), the strap adjuster (123), the hook (121), and a latch (e.g. 209 of FIG. 2) configured to lock the hook (121) to a secure position comprise a "hook-and-go" hinged strapping system.

The hook-and-go hinged strapping system enables a snowboard boot to enter and exit the snowboard binding conveniently. In one embodiment of the invention, the strap surface (119) is a one-piece plastic or rubber surface that comfortably fits over a frontal portion of a snowboard boot. The strap surface (119) is hinged on one side of a snowboard binding, which allows the hook-and-go hinged strapping system to be rotated out of an entry/exit pathway of the snowboard boot, when the hook (121) is not latched onto the latch (e.g. 209 of FIG. 2) of the snowboard binding. If the snowboard boot is placed inside the snowboard binding, the snowboarder can easily rotate the hook-and-go hinged strapping system over the snowboard boot and secure the hook (121) to the latch (e.g. 209 of FIG. 2) near the heel cup (105). Furthermore, in one embodiment of the invention, the strap adjuster (123) can tighten or shorten the length of the strap to secure the snowboard boot bound by the hook-and-go hinged strapping system. One example of the strap adjuster (123) is a cam buckle, which can be utilized by the snowboarder to tighten the strap. The snowboarder is able to achieve a desirable tight fit for the snowboard boot strapped inside the snowboard binding.

In one embodiment of the invention, the fixed hinged attachment on one side of the snowboard binding base (115) has two hinges, as shown in FIG. 1. On the opposite side of the snowboard binding base (115), a single point of locking (e.g. the latch (209) of FIG. 2) may securely hold the strap in a closed position.

In one embodiment of the invention, a unique type of cam buckle is used as the strap adjuster (123). This cam buckle is a ratchet which requires an outward pull of the cam buckle to move along teeth on the strap to tighten a snowboard boot strapped into a snowboard binding. The cam buckle (i.e. 123), as illustrated in FIG. 1, is configured to operate in a reverse direction of typical cam buckles.

The concept of easy entry/exit using the hook-and-go strapping system for a snowboard binding is novel. Conventional snowboard bindings require cumbersome effort to strap or release snowboard boots, because they do not have unique configuration of hinged attachment on one side of a strap and a hook-and-latch mechanism on the other side of the strap as disclosed in at least one embodiment of the present invention. The convenient tightening and releasing of a snowboard boot enabled by the hook-and-go strapping system provides substantial ergonomic and usability advantages over conventional snowboard binding designs.

Continuing with FIG. 1, in the preferred embodiment of the invention, the snowboard binding (100) also comprises a locking lever (117) and a spring-loaded locking plate (111) configured to protrude into a circular area (107) where a snowboard binding disc (e.g. 600 of FIG. 6, 707 of FIG. 7) is securely placed to hold the snowboard binding (100) and a snowboard underneath together.

In the preferred embodiment of the invention, the locking lever (117) has a locked position and a released position. If the locking lever (117) is in the released position, the spring-loaded locking plate (111) retracts from the circular area (107), thereby allowing the snowboard binding (100) to be rotated around the snowboard binding disc (e.g. 707 of FIG. 7) and the snowboard underneath when the snowboard binding disc is holding the snowboard binding and the snowboard together. If the locking lever (117) is in the locked position, the spring-loaded locking plate (111) protrudes into the circular area (107). When the snowboard binding disc is inserted into the circular area (107), the spring-loaded locking plate (111) penetrates into the snowboard binding disc (e.g. 707 of FIG. 7), which immobilizes or "locks" any rotational movements of the snowboard binding (100) around the snowboard binding disc and the snowboard underneath.

In one embodiment of the invention, the locking plate (111) has one or more spike prongs, as shown in FIG. 1. The multiple point of contact configuration of the locking plate (111) helps reducing or eliminating any undesirable miniscule sideways rotations even when the locking plate (111) is engaged into the snowboard binding disc.

Furthermore, in one embodiment of the invention, the locking lever (117) and the spring-loaded locking plate (111) as disclosed in the present invention enable "on-the-fly" stance positioning of a snowboard binding. Because at least one embodiment of the present invention enables an easy rotational or angular adjustment of a snowboard binding attached to a snowboard using a novel spring-loaded locking plate (111) and a locking lever (117) mechanism, the on-the-fly stance positioning made possible by the present invention provides substantially easier foot-position or stance adjustments over conventional snowboard binding designs, which did not allow dynamic rotational adjustments of snowboard bindings once a snowboard boot is strapped into a snowboard binding.

Continuing with FIG. 1, the snowboard binding (100) can also include a frontal rail (113), a side rail (109), and a heel cup (105), which may help a snowboard boot to be correctly placed inside the snowboard binding (100) and prevent undesirable dislocation of the snowboard boot outside of the snowboard binding (100). Moreover, in one embodiment of the invention, the frontal rail (113) may also be used as a snow scraper for the snowboard boot.

Furthermore, the snowboard binding (100) as illustrated in FIG. 1 may also include a forward lean bar (103), a tool-free forward lean adjuster (125) with one or more fitting grooves, and a tilt-adjustable articulating high back (101). In a preferred embodiment of the invention, the forward lean bar (103) and the tool-free forward lean adjuster (125) provide the snowboard binding (100) a unique ability to change an angle or a position of a leg support apparatus without using a tool such as a screw driver for easy ergonomic adjustment of a snowboarder's lower leg angle or position. In the preferred embodiment of the invention, the tool-free forward lean adjuster (125) can adjust a forward lean of a snowboarder's lower leg to a particular angle by placing a horizontal portion of the forward lean bar in a particular groove (e.g. 205 of FIG. 2). In addition, the tilt-adjustable articulating high back (101) is typically padded and provides further comfort to the snowboarder's lower leg for a particular forward-lean angle.

In one embodiment of the invention, the articulating high back (101) is a padded portion of a leg support apparatus, which flexibly supports a snowboarder's lower leg. In a preferred embodiment of the invention, the articulating high back (101) can be flexibly tilted forward or backward up to an allowed range of tilt. The flexible tilt feature of the articulating high back, when combined with the tool-free forward lean adjustment, provides a high level of leg position and angle (i.e. forward lean) adjustability and comfort. In particular, the articulating high back (101) ergonomically adjusts to alleviate pressure points on the snowboarder's lower leg, regardless of an aggressive angle of the forward lean. Most conventional snowboard bindings are unable to alleviate the pressure points. The unique leg support apparatus comprising the forward lean bar (103), the tool-free forward lean adjuster (125) with one or more fitting grooves, and the tilt-adjustable articulating high back (101) in one embodiment of the invention provides further user comfort and easy adjustment advantages over conventional snowboard binding designs.

Figure 2:
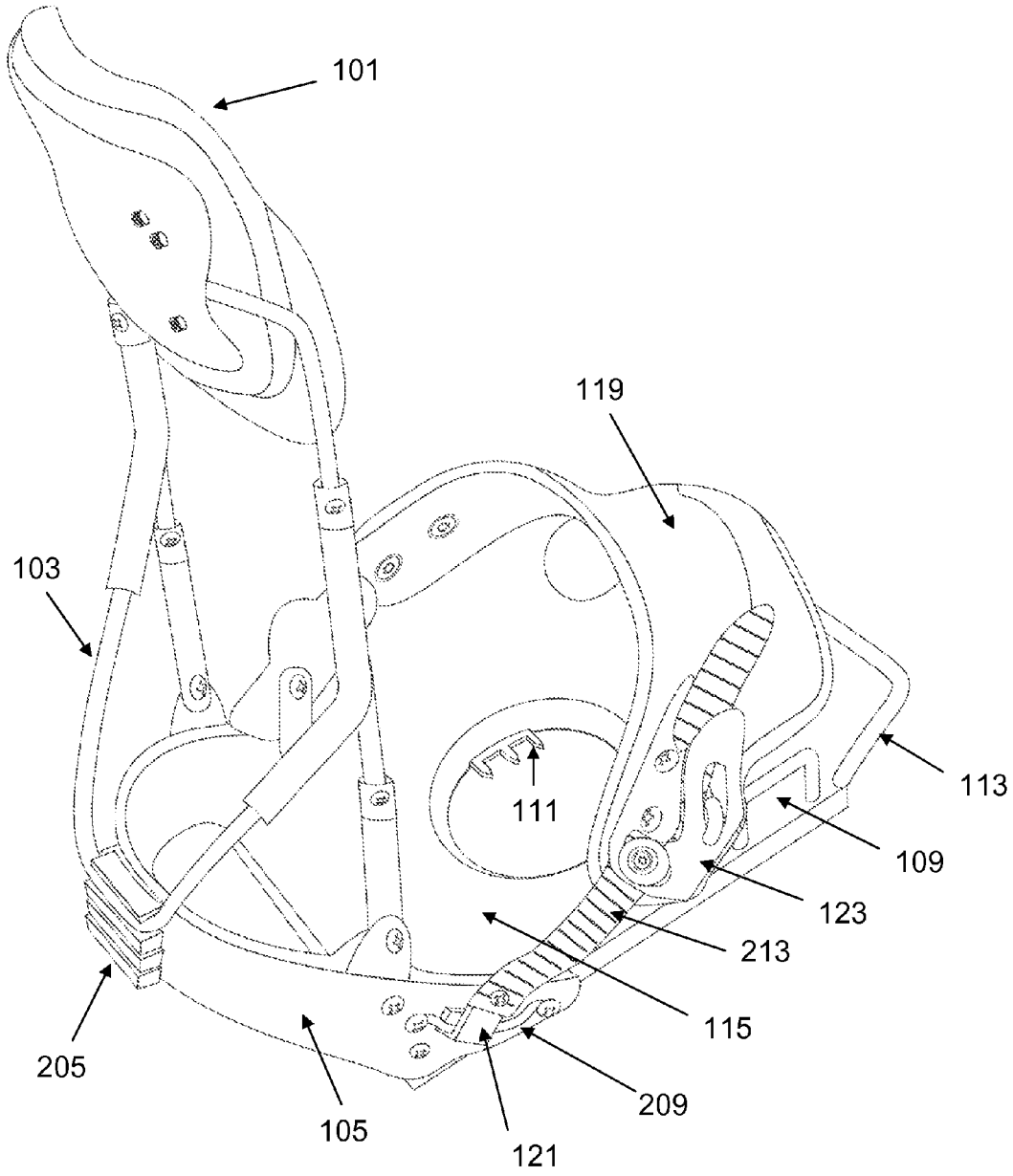
FIG. 2 shows a rear perspective view of a snowboard binding with a hinged strap in a closed position in accordance with an embodiment of the invention.

FIG. 2 shows a rear perspective view (200) of the snowboard binding (100) with a hinged strap (119, 123, 213, 121, 209) in a closed position in accordance with an embodiment of the invention. In a preferred embodiment of the invention, the snowboard binding (100) comprises a snowboard binding base (115), a strap surface (119) with a fixed hinged attachment on one side of the snowboard binding base (115), a strap adjuster (123) capable of lengthening or shortening the length of a strap (213), and a hook (121) on one end of the strap (213). In the preferred embodiment of the invention, the strap surface (119) with the fixed hinged attachment on one side of the snowboard binding base (115), the strap adjuster (123), the hook (121), and a latch (209) configured to lock the hook (121) to a secure position comprise a "hook-and-go" hinged strapping system. FIG. 2 shows the hook (121) and the latch (209) in the closed position.

The hook-and-go hinged strapping system enables a snowboard boot to enter and exit the snowboard binding conveniently. In one embodiment of the invention, the strap surface (119) is a one-piece plastic or rubber surface that comfortably fits over a frontal portion of a snowboard boot. The strap surface (119) is hinged on one side of a snowboard binding, which allows the hook-and-go hinged strapping system to be rotated out of an entry/exit pathway of the snowboard boot, when the hook (121) is not latched onto the latch (209) of the snowboard binding. If the snowboard boot is placed inside the snowboard binding, the snowboarder can easily rotate the hook-and-go hinged strapping system over the snowboard boot and secure the hook (121) to the latch (209) near the heel cup (105). Furthermore, in one embodiment of the invention, the strap adjuster (123) can tighten or shorten the length of the strap to secure the snowboard boot bound by the hook-and-go hinged strapping system. One example of the strap adjuster (123) is a cam buckle, which can be utilized by the snowboarder to tighten the strap. The snowboarder is able to achieve a desirable tight fit for the snowboard boot strapped inside the snowboard binding.

Continuing with FIG. 2, in the preferred embodiment of the invention, the snowboard binding (100) also comprises a locking lever (e.g. 117 of FIG. 1) and a spring-loaded locking plate (111) configured to protrude into a circular area (e.g. 107 of FIG. 1) where a snowboard binding disc (e.g. 600 of FIG. 6, 707 of FIG. 7) is securely placed to hold the snowboard binding (100) and a snowboard underneath together. In a preferred embodiment of the invention, the circular area has a wider-to-narrower tapered sidewall slope of 25 degrees from top to bottom, and a matching taper on a snowboard binding disc.

In the preferred embodiment of the invention, the locking lever has a locked position and a released position. If the locking lever is in the released position, the spring-loaded locking plate (111) retracts from the circular area, thereby allowing the snowboard binding (100) to be rotated around the snowboard binding disc (e.g. 707 of FIG. 7) and the snowboard underneath when the snowboard binding disc is holding the snowboard binding and the snowboard together. If the locking lever is in the locked position, the spring-loaded locking plate (111) protrudes into the circular area. When the snowboard binding disc is inserted into the circular area, the spring-loaded locking plate (111) penetrates into the snowboard binding disc (e.g. 707 of FIG. 7), which immobilizes or "locks" any rotational movements of the snowboard binding (100) around the snowboard binding disc and the snowboard underneath.

In one embodiment of the invention, the locking plate (111) has one or more spike prongs, as shown in FIG. 2. Furthermore, in one embodiment of the invention, the locking lever and the spring-loaded locking plate (111) as disclosed in the present invention enable "on-the-fly" stance positioning of a snowboard binding. Because at least one embodiment of the present invention enables an easy rotational or angular adjustment of a snowboard binding attached to a snowboard using a novel spring-loaded locking plate (111) and a locking lever mechanism, the on-the-fly stance positioning made possible by the present invention provides substantially easier foot-position or stance adjustments over conventional snowboard binding designs, which did not allow dynamic rotational adjustments of snowboard bindings once a snowboard boot is strapped into a snowboard binding.

Continuing with FIG. 2, the snowboard binding (100) can also include a frontal rail (113), a side rail (109), and a heel cup (105), which may help a snowboard boot to be correctly placed inside the snowboard binding (100) and prevent undesirable dislocation of the snowboard boot outside of the snowboard binding (100).

Furthermore, the snowboard binding (100) as illustrated in FIG. 2 may also include a forward lean bar (103), a tool-free forward lean adjuster (205) with one or more fitting grooves, and a tilt-adjustable articulating high back (101). In a preferred embodiment of the invention, the forward lean bar (103) and the tool-free forward lean adjuster (205) provide the snowboard binding (100) a unique ability to change an angle or a position of a leg support apparatus without using a tool such as a screw driver for easy ergonomic adjustment of a snowboarder's lower leg angle or position. In the preferred embodiment of the invention, the tool-free forward lean adjuster (205) can adjust a forward lean of a snowboarder's lower leg to a particular angle by placing a horizontal portion of the forward lean bar in a particular groove. In addition, the tilt-adjustable articulating high back (101) is typically padded and provides further comfort to the snowboarder's lower leg for a particular forward-lean angle.

In one embodiment of the invention, the articulating high back (101) is a padded portion of a leg support apparatus, which flexibly supports a snowboarder's lower leg. In a preferred embodiment of the invention, the articulating high back (101) can be flexibly tilted forward or backward up to an allowed range of tilt. The flexible tilt feature of the articulating high back, when combined with the tool-free forward lean adjustment, provides a high level of leg position and angle (i.e. forward lean) adjustability and comfort. The unique leg support apparatus comprising the forward lean bar (103), the tool-free forward lean adjuster (205) with one or more fitting grooves, and the tilt-adjustable articulating high back (101) in one embodiment of the invention provides further user comfort and easy adjustment advantages over conventional snowboard binding designs.

Figure 3:
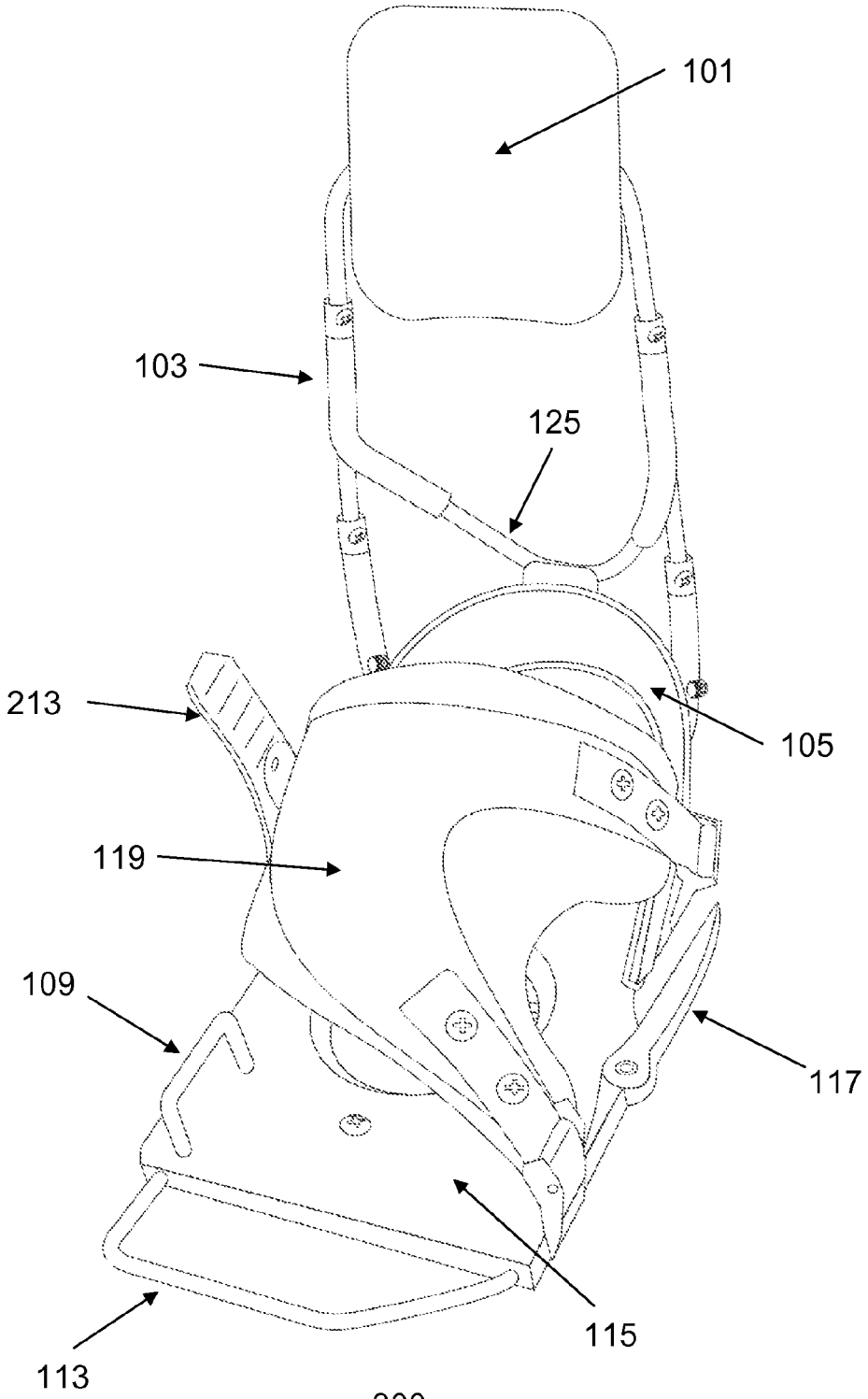
FIG. 3 shows a frontal perspective view of a snowboard binding with a hinged strap in a closed position in accordance with an embodiment of the invention.

FIG. 3 shows a frontal perspective view (300) of the snowboard binding (100) with a hinged strap (213, 119) in a closed position in accordance with an embodiment of the invention. In a preferred embodiment of the invention, the snowboard binding (100) comprises a snowboard binding base (115), a strap surface (119) with a fixed hinged attachment on one side of the snowboard binding base (115), a strap adjuster capable of lengthening or shortening the length of a strap (213), and a hook on one end of the strap (213). In the preferred embodiment of the invention, the strap surface (119) with the fixed hinged attachment on one side of the snowboard binding base (115), the strap adjuster, the hook, and a latch configured to lock the hook to a secure position comprise a "hook-and-go" hinged strapping system.

The hook-and-go hinged strapping system enables a snowboard boot to enter and exit the snowboard binding conveniently. In one embodiment of the invention, the strap surface (119) is a one-piece plastic or rubber surface that comfortably fits over a frontal portion of a snowboard boot. The strap surface (119) is hinged on one side of a snowboard binding, which allows the hook-and-go hinged strapping system to be rotated out of an entry/exit pathway of the snowboard boot, when the hook is not latched onto the latch of the snowboard binding. If the snowboard boot is placed inside the snowboard binding, the snowboarder can easily rotate the hook-and-go hinged strapping system over the snowboard boot and secure the hook to the latch near the heel cup (105). Furthermore, in one embodiment of the invention, the strap adjuster can tighten or shorten the length of the strap (213) to secure the snowboard boot bound by the hook-and-go hinged strapping system. One example of the strap adjuster is a cam buckle, which can be utilized by the snowboarder to tighten the strap (213). The snowboarder is able to achieve a desirable tight fit for the snowboard boot strapped inside the snowboard binding.

Continuing with FIG. 3, in the preferred embodiment of the invention, the snowboard binding (100) also comprises a locking lever (117) and a spring-loaded locking plate configured to protrude into a circular area where a snowboard binding disc (e.g. 600 of FIG. 6, 707 of FIG. 7) is securely placed to hold the snowboard binding (100) and a snowboard underneath together.

In one embodiment of the invention, the locking lever (117) and the spring-loaded locking plate as disclosed in the present invention enable "on-the-fly" stance positioning of a snowboard binding. Because at least one embodiment of the present invention enables an easy rotational or angular adjustment of a snowboard binding attached to a snowboard using a novel spring-loaded locking plate and a locking lever (117) mechanism, the on-the-fly stance positioning made possible by the present invention provides substantially easier foot-position or stance adjustments over conventional snowboard binding designs, which did not allow dynamic rotational adjustments of snowboard bindings once a snowboard boot is strapped into a snowboard binding.

Continuing with FIG. 3, the snowboard binding (100) can also include a frontal rail (113), a side rail (109), and a heel cup (105), which may help a snowboard boot to be correctly placed inside the snowboard binding (100) and prevent undesirable dislocation of the snowboard boot outside of the snowboard binding (100).

Furthermore, the snowboard binding (100) as illustrated in FIG. 3 may also include a forward lean bar (103), a tool-free forward lean adjuster (125) with one or more fitting grooves, and a tilt-adjustable articulating high back (101). In a preferred embodiment of the invention, the forward lean bar (103) and the tool-free forward lean adjuster (125) provide the snowboard binding (100) a unique ability to change an angle or a position of a leg support apparatus without using a tool such as a screw driver for easy ergonomic adjustment of a snowboarder's lower leg angle or position. In the preferred embodiment of the invention, the tool-free forward lean adjuster (125) can adjust a forward lean of a snowboarder's lower leg to a particular angle by placing a horizontal portion of the forward lean bar in a particular groove (e.g. 205 of FIG. 2). In addition, the tilt-adjustable articulating high back (101) is typically padded and provides further comfort to the snowboarder's lower leg for a particular forward-lean angle.

In one embodiment of the invention, the articulating high back (101) is a padded portion of a leg support apparatus, which flexibly supports a snowboarder's lower leg. In a preferred embodiment of the invention, the articulating high back (101) can be flexibly tilted forward or backward up to an allowed range of tilt. The flexible tilt feature of the articulating high back, when combined with the tool-free forward lean adjustment, provides a high level of leg position and angle (i.e. forward lean) adjustability and comfort. The unique leg support apparatus comprising the forward lean bar (103), the tool-free forward lean adjuster (125) with one or more fitting grooves, and the tilt-adjustable articulating high back (101) in one embodiment of the invention provides further user comfort and easy adjustment advantages over conventional snowboard binding designs.

Figure 4:
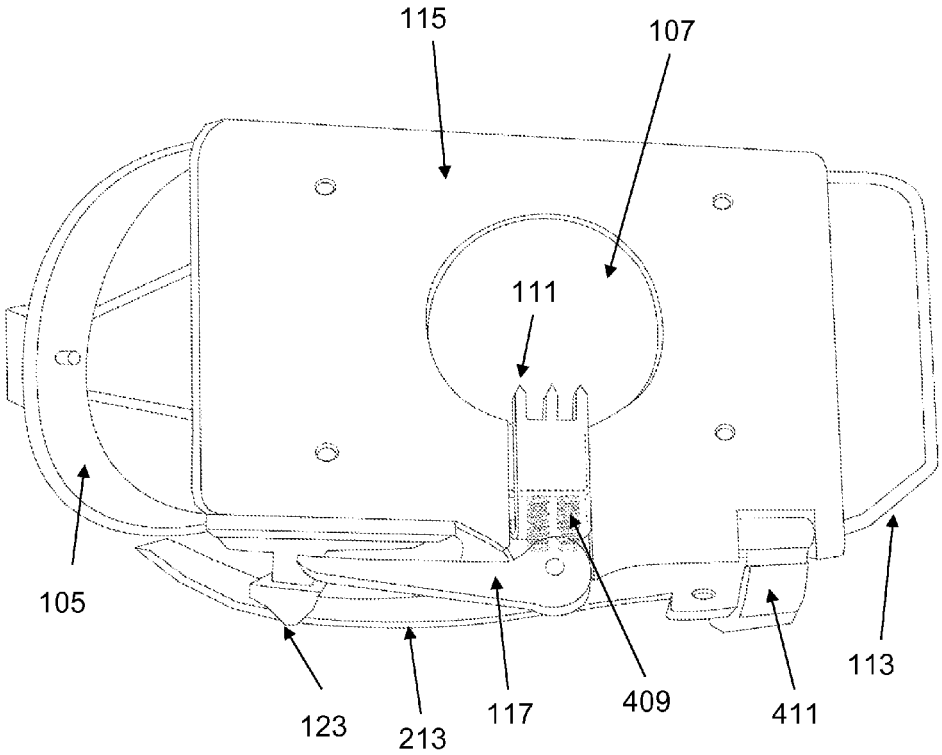
FIG. 4 shows a bottom perspective view of a snowboard binding in accordance with an embodiment of the invention.

FIG. 4 shows a bottom perspective view (400) of the snowboard binding (100) in accordance with an embodiment of the invention. The bottom perspective view shows a snowboard binding base (115), a strap (213) which binds a snowboard boot, a fixed hinge (411) which attaches one side of a strap (213), a strap adjuster (123) capable of lengthening or shortening the length of a strap (213).

FIG. 4 also shows a locking lever (117), a conceptual shape of spring elements (409) between the locking lever (117) and the locking plate (111) in perforated lines, and the spring-loaded locking plate (111). In one embodiment of the invention, the spring elements (409) enable retraction and protrusion of the spring-loaded locking plate (111) into a circular area (107) where a snowboard binding disc (e.g. 600 of FIG. 6, 707 of FIG. 7) is securely placed to hold the snowboard binding (100) and a snowboard underneath together.

In the preferred embodiment of the invention, the locking lever (117) has a locked position and a released position. If the locking lever (117) is in the released position, the spring-loaded locking plate (111) retracts from the circular area (107), thereby allowing the snowboard binding (100) to be rotated around the snowboard binding disc (e.g. 707 of FIG. 7) and the snowboard underneath when the snowboard binding disc is holding the snowboard binding and the snowboard together. If the locking lever (117) is in the locked position, the spring-loaded locking plate (111) protrudes into the circular area (107). When the snowboard binding disc is inserted into the circular area (107), the spring-loaded locking plate (111) penetrates into the snowboard binding disc (e.g. 707 of FIG. 7), which immobilizes or "locks" any rotational movements of the snowboard binding (100) around the snowboard binding disc and the snowboard underneath.

In one embodiment of the invention, the locking plate (111) has one or more spike prongs, as shown in FIG. 4. Furthermore, in one embodiment of the invention, the locking lever (117) and the spring-loaded locking plate (111) as disclosed in the present invention enable "on-the-fly" stance positioning of a snowboard binding. Because at least one embodiment of the present invention enables an easy rotational or angular adjustment of a snowboard binding attached to a snowboard using a novel spring-loaded locking plate (111) and a locking lever (117) mechanism, the on-the-fly stance positioning made possible by the present invention provides substantially easier foot-position or stance adjustments over conventional snowboard binding designs, which did not allow dynamic rotational adjustments of snowboard bindings once a snowboard boot is strapped into a snowboard binding.

Continuing with FIG. 4, the snowboard binding can also include a frontal rail (113) and a heel cup (105), which may help a snowboard boot to be correctly placed inside the snowboard binding (100) and prevent undesirable dislocation of the snowboard boot outside of the snowboard binding (100).

Figure 5:
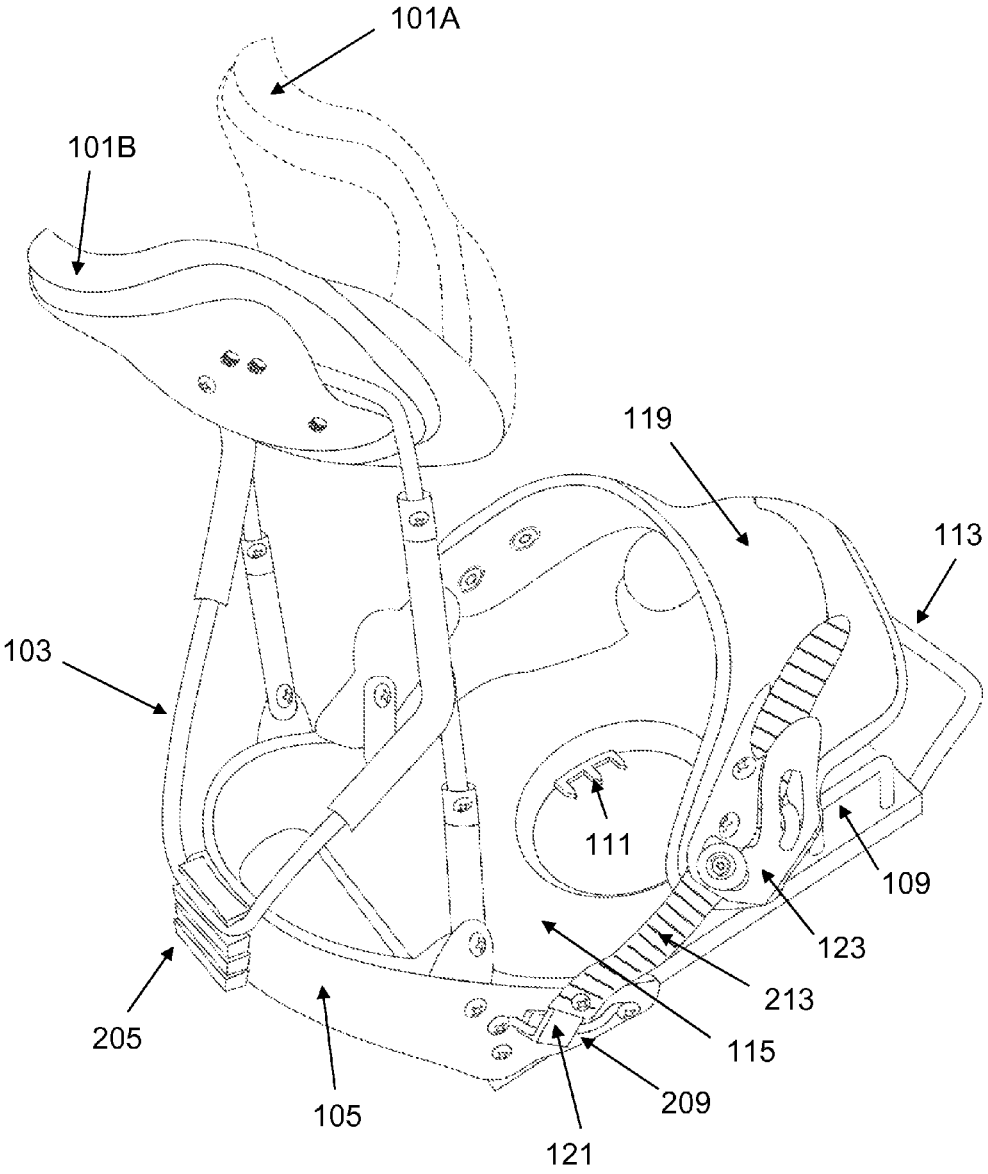
FIG. 5 shows another rear perspective view of a snowboard binding with a hinged strap in a closed position and an articulating high back, in accordance with an embodiment of the invention.

FIG. 5 shows another rear perspective view (500) of the snowboard binding (100) with a hinged strap (119, 123, 213, 121, 209) in a closed position and an articulating high back, in accordance with an embodiment of the invention. In a preferred embodiment of the invention, the snowboard binding (100) comprises a snowboard binding base (115), a strap surface (119) with a fixed hinged attachment on one side of the snowboard binding base (115), a strap adjuster (123) capable of lengthening or shortening the length of a strap (213), and a hook (121) on one end of the strap (213). In the preferred embodiment of the invention, the strap surface (119) with the fixed hinged attachment on one side of the snowboard binding base (115), the strap adjuster (123), the hook (121), and a latch (209) configured to lock the hook (121) to a secure position comprise a "hook-and-go" hinged strapping system. FIG. 5 shows the hook (121) and the latch (209) in the closed position.

The hook-and-go hinged strapping system enables a snowboard boot to enter and exit the snowboard binding conveniently. In one embodiment of the invention, the strap surface (119) is a one-piece plastic or rubber surface that comfortably fits over a frontal portion of a snowboard boot. The strap surface (119) is hinged on one side of a snowboard binding, which allows the hook-and-go hinged strapping system to be rotated out of an entry/exit pathway of the snowboard boot, when the hook (121) is not latched onto the latch (209) of the snowboard binding. If the snowboard boot is placed inside the snowboard binding, the snowboarder can easily rotate the hook-and-go hinged strapping system over the snowboard boot and secure the hook (121) to the latch (209) near the heel cup (105). Furthermore, in one embodiment of the invention, the strap adjuster (123) can tighten or shorten the length of the strap to secure the snowboard boot bound by the hook-and-go hinged strapping system. One example of the strap adjuster (123) is a cam buckle, which can be utilized by the snowboarder to tighten the strap. The snowboarder is able to achieve a desirable tight fit for the snowboard boot strapped inside the snowboard binding.

Continuing with FIG. 5, in the preferred embodiment of the invention, the snowboard binding (100) also comprises a locking lever (e.g. 117 of FIG. 1) and a spring-loaded locking plate (523) configured to protrude into a circular area (e.g. 107 of FIG. 1) where a snowboard binding disc (e.g. 600 of FIG. 6, 707 of FIG. 7) is securely placed to hold the snowboard binding (100) and a snowboard underneath together.

In the preferred embodiment of the invention, the locking lever has a locked position and a released position. If the locking lever is in the released position, the spring-loaded locking plate (523) retracts from the circular area, thereby allowing the snowboard binding (100) to be rotated around the snowboard binding disc (e.g. 707 of FIG. 7) and the snowboard underneath when the snowboard binding disc is holding the snowboard binding and the snowboard together. If the locking lever is in the locked position, the spring-loaded locking plate (523) protrudes into the circular area. When the snowboard binding disc is inserted into the circular area, the spring-loaded locking plate (523) penetrates into the snowboard binding disc (e.g. 707 of FIG. 7), which immobilizes or "locks" any rotational movements of the snowboard binding (100) around the snowboard binding disc and the snowboard underneath.

In one embodiment of the invention, the locking plate (523) has one or more spike prongs, as shown in FIG. 5. Furthermore, in one embodiment of the invention, the locking lever and the spring-loaded locking plate (523) as disclosed in the present invention enable "on-the-fly" stance positioning of a snowboard binding. Because at least one embodiment of the present invention enables an easy rotational or angular adjustment of a snowboard binding attached to a snowboard using a novel spring-loaded locking plate (523) and a locking lever mechanism, the on-the-fly stance positioning made possible by the present invention provides substantially easier foot-position or stance adjustments over conventional snowboard binding designs, which did not allow dynamic rotational adjustments of snowboard bindings once a snowboard boot is strapped into a snowboard binding.

Continuing with FIG. 5, the snowboard binding (100) can also include a frontal rail (113), a side rail (109), and a heel cup (105), which may help a snowboard boot to be correctly placed inside the snowboard binding (100) and prevent undesirable dislocation of the snowboard boot outside of the snowboard binding (100).

Furthermore, the snowboard binding (100) as illustrated in FIG. 5 may also include a forward lean bar (103), a tool-free forward lean adjuster (205) with one or more fitting grooves, and a tilt-adjustable articulating high back (101A and 101B). As illustrated by perforated lines for a more upright tilt angle (101A) and solid lines for a more laid tilt angle (101B), the tilt-adjustable articulating high back (101A and 101B) can be flexibly tilted forward or backward up to an allowed range of tilt. The flexible tilt feature of the articulating high back, when combined with the tool-free forward lean adjustment, provides a high level of leg position and angle (i.e. forward lean) adjustability and comfort. The unique leg support apparatus comprising the forward lean bar (103), the tool-free forward lean adjuster (205) with one or more fitting grooves, and the tilt-adjustable articulating high back (101A and 101B) in one embodiment of the invention provides further user comfort and easy adjustment advantages over conventional snowboard binding designs.

Figure 6:
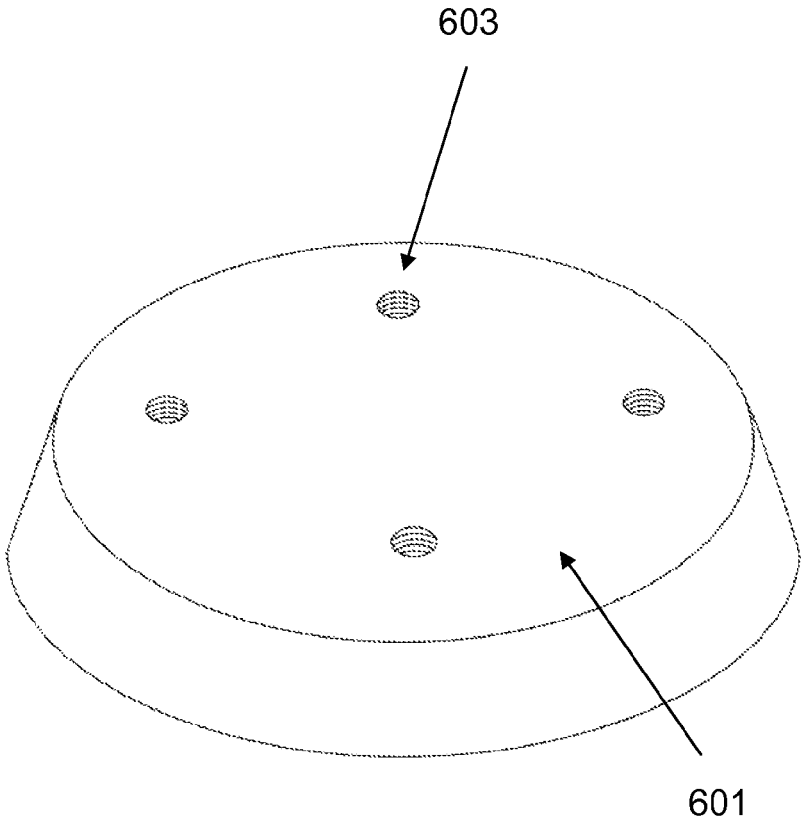
FIG. 6 shows a snowboard binding disc in accordance with an embodiment of the invention.

FIG. 6 shows a snowboard binding disc (600) in accordance with an embodiment of the invention. In one embodiment of the invention, the snowboard binding disc (600) has one or more screw holes (603) through top and bottom surfaces (601) of the snowboard binding disc (600). The snowboard binding disc (600) is configured to fit into a circular area (e.g. 107 of FIG. 1) of a snowboard binding with one or more screws holding the snowboard binding disc (600), the snowboard binding (e.g. 100 or 700), and a snowboard placed underneath the snowboard binding together. Although the snowboard binding disc (600) is illustrated with the one or more screw holes (603) for one embodiment of the invention, other means of attaching the snowboarding binding disc (600) with the snowboard binding and the snowboard may also be utilized in other embodiments of the invention.

Figure 7:
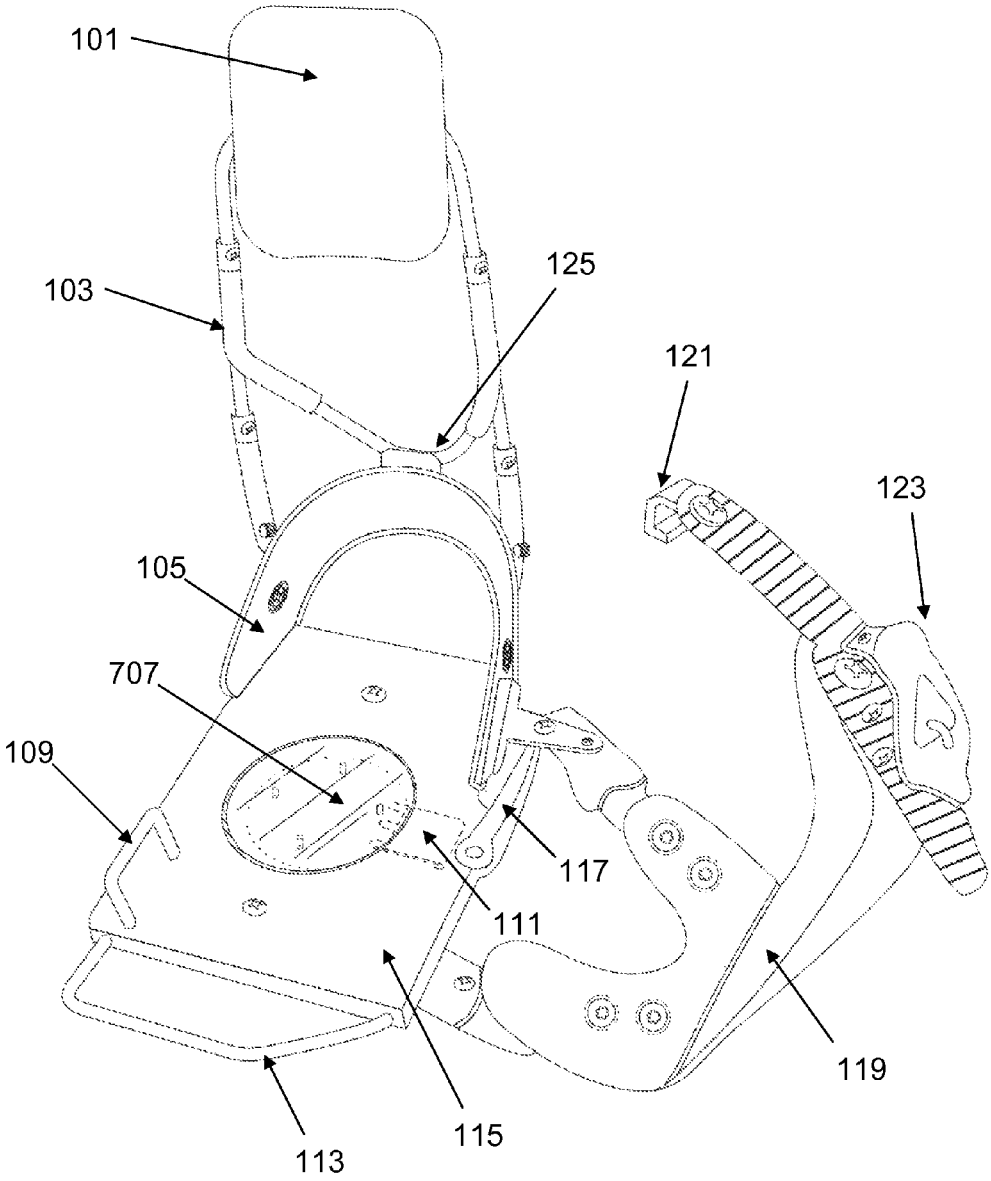
FIG. 7 shows a snowboard binding disc placed on top of a snowboard binding in accordance with an embodiment of the invention.

FIG. 7 shows a snowboard binding disc (707) placed on top of a snowboard binding (700) in accordance with an embodiment of the invention. In a preferred embodiment of the invention, the snowboard binding (700) comprises a snowboard binding base (115), a strap surface (119) with a fixed hinged attachment on one side of the snowboard binding base (115), a strap adjuster (123) capable of lengthening or shortening the length of a strap, and a hook (121) on one end of the strap. In the preferred embodiment of the invention, the strap surface (119) with the fixed hinged attachment on one side of the snowboard binding base (115), the strap adjuster (123), the hook (121), and a latch (e.g. 209 of FIG. 2) configured to lock the hook (121) to a secure position comprise a "hook-and-go" hinged strapping system.

The hook-and-go hinged strapping system enables a snowboard boot to enter and exit the snowboard binding conveniently. In one embodiment of the invention, the strap surface (119) is a one-piece plastic or rubber surface that comfortably fits over a frontal portion of a snowboard boot. The strap surface (119) is hinged on one side of a snowboard binding, which allows the hook-and-go hinged strapping system to be rotated out of an entry/exit pathway of the snowboard boot, when the hook (121) is not latched onto the latch (e.g. 209 of FIG. 2) of the snowboard binding. If the snowboard boot is placed inside the snowboard binding, the snowboarder can easily rotate the hook-and-go hinged strapping system over the snowboard boot and secure the hook (121) to the latch (e.g. 209 of FIG. 2) near the heel cup (105). Furthermore, in one embodiment of the invention, the strap adjuster (123) can tighten or shorten the length of the strap to secure the snowboard boot bound by the hook-and-go hinged strapping system. One example of the strap adjuster (123) is a cam buckle, which can be utilized by the snowboarder to tighten the strap. The snowboarder is able to achieve a desirable tight fit for the snowboard boot strapped inside the snowboard binding.

The concept of easy entry/exit using the hook-and-go strapping system for a snowboard binding is novel. Conventional snowboard bindings require cumbersome effort to strap or release snowboard boots, because they do not have unique configuration of hinged attachment on one side of a strap and a hook-and-latch mechanism on the other side of the strap as disclosed in at least one embodiment of the present invention. The convenient tightening and releasing of a snowboard boot enabled by the hook-and-go strapping system provides substantial ergonomic and usability advantages over conventional snowboard binding designs.

Continuing with FIG. 7, in the preferred embodiment of the invention, the snowboard binding (700) also comprises a locking lever (117) and a spring-loaded locking plate (111) configured to protrude into a snowboard binding disc (707), which is screwed into a snowboard beneath the snowboard binding (700) to hold the snowboard binding (700) and the snowboard together.

In the preferred embodiment of the invention, the locking lever (117) has a locked position and a released position. If the locking lever (117) is in the released position, the spring-loaded locking plate (111) retracts from the snowboard binding disc (707), thereby allowing the snowboard binding (700) to be rotated around the snowboard binding disc (707) and the snowboard underneath when the snowboard binding disc (707) is holding the snowboard binding and the snowboard together. If the locking lever (117) is in the locked position, the spring-loaded locking plate (111) protrudes into the snowboard binding disc (707), which immobilizes or "locks" any rotational movements of the snowboard binding (700) around the snowboard binding disc and the snowboard underneath.

In one embodiment of the invention, the locking plate (111) has one or more spike prongs, as shown in FIG. 7. Furthermore, in one embodiment of the invention, the locking lever (117) and the spring-loaded locking plate (111) as disclosed in the present invention enable "on-the-fly" stance positioning of a snowboard binding. Because at least one embodiment of the present invention enables an easy rotational or angular adjustment of a snowboard binding attached to a snowboard using a novel spring-loaded locking plate (111) and a locking lever (117) mechanism, the on-the-fly stance positioning made possible by the present invention provides substantially easier foot-position or stance adjustments over conventional snowboard binding designs, which did not allow dynamic rotational adjustments of snowboard bindings once a snowboard boot is strapped into a snowboard binding.

Continuing with FIG. 7, the snowboard binding (700) can also include a frontal rail (113), a side rail (109), and a heel cup (105), which may help a snowboard boot to be correctly placed inside the snowboard binding (700) and prevent undesirable dislocation of the snowboard boot outside of the snowboard binding (700).

Furthermore, the snowboard binding (700) as illustrated in FIG. 7 may also include a forward lean bar (103), a tool-free forward lean adjuster (125) with one or more fitting grooves, and a tilt-adjustable articulating high back (101). In a preferred embodiment of the invention, the forward lean bar (103) and the tool-free forward lean adjuster (125) provide the snowboard binding (700) a unique ability to change an angle or a position of a leg support apparatus without using a tool such as a screw driver for easy ergonomic adjustment of a snowboarder's lower leg angle or position. In the preferred embodiment of the invention, the tool-free forward lean adjuster (125) can adjust a forward lean of a snowboarder's lower leg to a particular angle by placing a horizontal portion of the forward lean bar in a particular groove (e.g. 205 of FIG. 2). In addition, the tilt-adjustable articulating high back (101) is typically padded and provides further comfort to the snowboarder's lower leg for a particular forward-lean angle.

In one embodiment of the invention, the articulating high back (101) is a padded portion of a leg support apparatus, which flexibly supports a snowboarder's lower leg. In a preferred embodiment of the invention, the articulating high back (101) can be flexibly tilted forward or backward up to an allowed range of tilt. The flexible tilt feature of the articulating high back, when combined with the tool-free forward lean adjustment, provides a high level of leg position and angle (i.e. forward lean) adjustability and comfort. The unique leg support apparatus comprising the forward lean bar (103), the tool-free forward lean adjuster (125) with one or more fitting grooves, and the tilt-adjustable articulating high back (101) in one embodiment of the invention provides further user comfort and easy adjustment advantages over conventional snowboard binding designs.

The snowboard binding as embodied by the present invention provides several advantages over conventional snowboard binding designs. First, by incorporating a novel hook-and-go strapping system for a snowboard binding, the present invention reduces or eliminates cumbersome effort to strap or release snowboard boots in an inconvenient and restrictive manner as practiced in conventional snowboard binding designs. The unique configuration of hinged attachment on one side of a strap and a hook-and-latch mechanism on the other side of the strap as disclosed in at least one embodiment of the present invention provides substantial ergonomic and usability advantages over conventional snowboard binding designs.

Second, by incorporating a locking lever and a spring-loaded locking plate to enable a unique "on-the-fly" stance positioning of a snowboard binding, the present invention provides an easy rotational or angular adjustment of a snowboard binding attached to a snowboard using the novel spring-loaded locking plate and the locking lever mechanism. At least one embodiment of the present invention provides substantially easier foot-position or stance adjustments over conventional snowboard binding designs, which did not allow dynamic rotational adjustments of snowboard bindings once a snowboard boot is strapped into a snowboard binding.

Furthermore, the unique leg support apparatus comprising a forward lean bar, a tool-free forward lean adjuster with one or more fitting grooves, and a tilt-adjustable articulating high back at least in one embodiment of the invention provides further user comfort and easy adjustment advantages over conventional snowboard binding designs.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A snowboard binding for securely placing a snowboard boot, the snowboard binding comprising:

a snowboard binding base;

a strap with a strap surface, a strap adjuster, and a hook, wherein the strap has a fixed hinge on a first side of the strap and the hook on a second side of the strap;

a latch which can receive the hook for forming a closed position for the strap, wherein the strap can be tightened with the strap adjuster to hold the snowboard boot securely in the closed position; and a spring-loaded locking plate transversely contacting a locking lever with at least two spring elements, which are parallel to each other, interposed between the spring-loaded locking plate and the locking lever, wherein the locking lever transversely acts on the spring-loaded locking plate to make the spring-loaded locking plate either protrude into an initially non-toothed snowboard binding disc to lock a rotational position of the snowboard binding, or retract from the initially non-toothed snowboard binding disc to release the rotational position of the snowboard binding.

2. The snowboard binding of claim 1, further comprising a circular area to which the snowboard binding disc is screwed into a snowboard underneath the snowboard binding to hold the snowboard binding and the snowboard together.

3. The snowboard binding of claim 1, further comprising a heel cup, a forward lean bar operatively connected to the heel cup, a tool-free forward lean adjuster designed to be placed in a fitting groove, and a tilt-adjustable articulating high back.

4. The snowboard binding of claim 3, wherein the tool-free forward lean adjuster can be secured in one or more fitting grooves when a forward lean angle adjustment is needed to change a position or an angle of a lower leg of a snowboarder.

5. The snowboard binding of claim 1, further comprising a side rail and a frontal rail to minimize chances of dislocation of the snowboard boot when the snowboard boot is placed inside the snowboard binding.

6. The snowboard binding of claim 1, wherein the strap adjuster is a cam buckle.

7. The snowboard binding of claim 1, wherein the strap surface covers a substantial portion of the snowboard boot when the snowboard boot is placed inside the snowboard binding.

8. The snowboard binding of claim 1, wherein the locking lever has a locked position and a released position, wherein the locked position enables the spring-loaded locking plate to protrude into the snowboard binding disc to form a secure lock against any rotational movements of the snowboard binding, and wherein the released position enables the spring-loaded locking plate to retract away from the snowboard binding disc to allow rotational adjustment of the snowboard binding.

9. The snowboard binding of claim 1, wherein the strap surface is made of rubber or plastic materials.

10. The snowboard binding of claim 1, wherein the tilt-adjustable articulating high back is padded for comfort and is able to tilt forward or backward.

11. A hook-and-go hinged strapping system for a snowboard binding, the hook-and-go hinged strapping system comprising:

a snowboard binding base;

a strap with a strap surface, a strap adjuster, and a hook, wherein the strap has a fixed hinge on a first side of the strap and the hook on a second side of the strap and wherein the strap provides an open position for an easy entry or exit for a snowboard boot;

a latch which can receive the hook for forming a closed position for the strap, wherein the strap can be tightened with the strap adjuster to hold the snowboard boot securely in the closed position;

a spring-loaded locking plate transversely contacting a locking lever with at least two spring elements, which are parallel to each other, interposed between the spring-loaded locking plate and the locking lever, wherein the locking lever transversely acts on the spring-loaded locking plate to make the spring-loaded locking plate either protrude into an initially non-toothed snowboard binding disc to lock a rotational position of the snowboard binding, or retract from the initially non-toothed snowboard binding disc to release the rotational position of the snowboard binding.

12. The hook-and-go hinged strapping system of claim 11, further comprising a heel cup, a forward lean bar operatively connected to the heel cup, a tool-free forward lean adjuster designed to be placed in a fitting groove, and a tilt-adjustable articulating high back.

13. The hook-and-go hinged strapping system of claim 12, wherein the tool-free forward lean adjuster can be secured in one or more fitting grooves when a forward lean angle adjustment is needed to change a position or an angle of a lower leg of a snowboarder.

14. The hook-and-go hinged strapping system of claim 11, further comprising a side rail and a frontal rail to minimize chances of dislocation of the snowboard boot when the snowboard boot is placed inside the snowboard binding.

15. The hook-and-go hinged strapping system of claim 11, wherein the strap adjuster is a cam buckle.

16. The hook-and-go hinged strapping system of claim 11, wherein the strap surface covers a substantial portion of the snowboard boot when the snowboard boot is placed inside the snowboard binding.

17. The hook-and-go hinged strapping system of claim 11, wherein the strap surface is made of rubber or plastic materials.

18. The hook-and-go hinged strapping system of claim 12, wherein the tilt-adjustable articulating high back is padded for comfort and is able to tilt forward or backward.

19. An on-the-fly stance positioning apparatus for a snowboard binding, the on-the-fly stance positioning apparatus comprising:

a snowboard binding base;

a spring-loaded locking plate transversely contacting a locking lever with at least two spring elements, which are parallel to each other, interposed between the spring-loaded locking plate and the locking lever, wherein the locking lever transversely acts on the spring-loaded locking plate to make the spring-loaded locking plate either protrude into an initially non-toothed snowboard binding disc to lock a rotational position of the snowboard binding, or retract from the initially non-toothed snowboard binding disc to release the rotational position of the snowboard binding; and the locking lever controlling the spring-loaded locking plate to be placed in a locked position or a released position.

20. The on-the-fly stance positioning apparatus of claim 19, further comprising a circular area to which the snowboard binding disc is screwed into a snowboard underneath the snowboard binding to hold the snowboard binding and the snowboard together.

* * * * *